US006374445B1

(12) United States Patent
Fuessinger et al.

(10) Patent No.: US 6,374,445 B1
(45) Date of Patent: Apr. 23, 2002

(54) TENSION ROD FOR USE AS A CHORD FOR BRIDGES

(75) Inventors: Reinhold Fuessinger, Friedrichshafen; Friedrich Graf, Daisendorf, both of (DE)

(73) Assignee: Dornier GmbH, Friedrichshafen (DE)

( * ) Notice: Subject to any disclaimer, the term of this patent is extended or adjusted under 35 U.S.C. 154(b) by 0 days.

(21) Appl. No.: 09/339,237

(22) Filed: Jun. 24, 1999

(30) Foreign Application Priority Data

Jun. 27, 1998 (DE) ..... 198 28 835

(51) Int. Cl.[7] ..... E01D 19/00; E04C 3/30

(52) U.S. Cl. ..... 14/14; 14/13; 14/77.1; 52/737.3; 52/740.1; 403/364

(58) Field of Search ..... 14/13, 14, 2.4, 14/22, 77.1; 428/545; 52/740.1, 737.3; 404/134; 403/266, 364; 144/346

(56) References Cited

U.S. PATENT DOCUMENTS 3,480,054 A * 11/1969 Marian ..... 403/266
3,692,340 A * 9/1972 Roth ..... 403/266 T
3,754,293 A 8/1973 Wagner et al. ..... 14/1
3,947,309 A * 3/1976 Troutner ..... 156/248
4,558,968 A * 12/1985 Meickl ..... 403/174
4,729,605 A * 3/1988 Imao et al. ..... 301/104
5,875,604 A * 3/1999 Rudd ..... 52/731.8
6,036,279 A * 3/2000 Campagnolo ..... 301/55

FOREIGN PATENT DOCUMENTS

| | | |
|---|---|---|
| DE | 198 28 835 | 6/1998 |
| FR | 2 409 449 | 11/1978 |
| FR | 2 683 559 | 5/1993 |

* cited by examiner

*Primary Examiner*—Gary S. Hartmann
(74) *Attorney, Agent, or Firm*—Crowell & Moring LLP

(57) ABSTRACT

Tension rod for use as a chord for bridges, having a middle part consisting of fiber composite material and having ends consisting of metallic material. The middle and end parts are connected by a glued tapered overlap.

30 Claims, 2 Drawing Sheets

TENSION ROD FOR USE AS A CHORD FOR BRIDGES

BACKGROUND AND SUMMARY OF THE INVENTION

This application claims the priority of German patent 198 28 835.2-25, filed Jun. 27, 1998, the disclosure of which is expressly incorporated by reference herein.

The invention relates to a tension rod for use as a chord for bridges, having a middle part made of fiber composite and having ends made of metal material.

Fiber composites exhibit high stiffness and strength relative to their specific density. This property makes them especially valuable for lightweight construction applications. Advantages are realized especially when the fibers can be subjected to tensile stress in the lengthwise direction.

Structural elements of this kind are subjected primarily to locally concentrated forces which often also have different directions in space.

When a part stressed in this fashion is developed using fiber construction, the introduction of forces into the fibers poses a problem which as a rule must be solved at high cost. These costly solutions are accordingly expensive so that they are rarely chosen for applications outside of aviation and space travel. In addition, many of the advantages of fiber materials are lost in multiaxially stressed states.

For example, winding techniques are used in which the fibers are wound at the end around a metal eye. This is a very expensive method for manufacturing, quality assurance, and monitoring of service life.

Methods are also known in which the ends of the fibers are clamped in a cone that is subjected to tensile force.

In addition, glued tapered overlaps between the fiber composite and metal fittings are also known for simple requirements but these, in the case of primary components and high loads, are additionally secured by bolts or rivets in order to be able to accept the load if the glued connection fails.

Very strict requirements are imposed on mobile bridges regarding weight, dimensions, rigidity, and strength so that the use of fiber composite materials is attractive. However, there are the following problems with using fiber composite materials:

(a) Relatively high sensitivity to mechanical damage.

(b) Mobile bridges must be taken apart into transportable units. This means that high concentrated forces must be repeatedly introduced into and brought out from the structures.

(c) A bridge structure, for practical and economic reasons, can be examined for damage only at relatively long intervals, in other words the structure must be reliable, error-tolerant, and easy to check.

An object goal of the invention is to provide a tension rod made of fiber composite material for use as a chord for mobile bridges. This and other objects have been achieved according to the present invention by providing a tension rod for use as a chord for bridges, comprising at least one chord including: a middle part made of a fiber composite material; and a pair of end parts made of a metallic material, wherein each of said end parts is connected to said middle part via a glued tapered overlap, the middle part and the end parts having rectangular cross sections at said overlap, a length of said overlap being greater than a thickness of the tension rod at the overlap, and said overlap of the fiber composite part and the metal part extending bladewise on the thin sides.

This and other objects have been achieved according to the present invention by providing a tension rod, comprising at least one chord including: a middle part made of a fiber composite material, said middle part having a rectangular cross section which gradually decreases in thickness at each longitudinal end to define tapered connection areas; a pair of end parts made of a metallic material, each of said end parts having a rectangular cross section which gradually decreases in thickness at one longitudinal end to define a tapered connection area which matingly corresponds to the respective tapered connection area of the middle part; and a glued connection between said tapered connection areas of the middle part and said tapered connection areas of the end parts, respectively.

This and other objects have been achieved according to the present invention by providing a method of making a tension rod, comprising: providing a middle part made of a fiber composite material, said middle part having a rectangular cross section which gradually decreases in thickness at each longitudinal end to define tapered connection areas; providing a pair of end parts made of a metallic material, each of said end parts having a rectangular cross section which gradually decreases in thickness at one longitudinal end to define a tapered connection area which matingly corresponds to the respective tapered connection area of the middle part; and gluing said tapered connection areas of the middle part to said tapered connection areas of the end parts, respectively.

The subject of the invention is the introduction of forces into, or their departure from, a fiber composite by a tapered overlap designed according to the invention with the following properties:

(a) The cost is only a fraction of that for a solution involving winding.

(i) The fiber composite can be manufactured economically; manufacture can be automated.

(ii) The metal end fittings are likewise parts that are simple to manufacture.

(iii) The gluing of the parts is likewise economical because of the geometry and can be automated.

(iv) A chord consists of only two different individual parts which therefore can be manufactured in correspondingly large numbers.

(b) Having metal end fittings at the coupling points that are subjected to high mechanical loads ensures that the fiber composite is not damaged mechanically when coupling.

(c) The present invention is well-suited for repeated introduction and departure of forces without making the design extremely expensive as a result or calling into question the advantages of the fiber composite.

(d) The chords are reliable, error-tolerant, and readily checked.

(i) The reliability of the chord depends to a large degree on the quality of gluing during manufacture. By constructing the chords from individually manufactured elements with the simplest geometry, the chords can be checked 100% following each workstep using conventional methods such as ultrasound or x-rays.

(ii) The reliability of the chord also depends on a possible aging of the glue during operation by the penetration of water vapor. The design of the tapered overlap provides the highly stressed large-area glued connections of the overlap relative to the environments with excellent protection by the metal fittings against the penetration of water vapor. The very small lateral surfaces can be protected with known methods, for example by a glued metal film, 0.1 to 0.3 mm thick.

(iii) If individual elements should fail, the layer-wise construction ensures that cracks cannot propagate further.

(iv) The chords can also be checked as double or multiple chords using the same test procedures as during a manufacture.

Other objects, advantages and novel features of the present invention will become apparent from the following detailed description of the invention when considered in conjunction with the accompanying drawings.

DETAILED DESCRIPTION OF THE DRAWINGS

Figure 2:
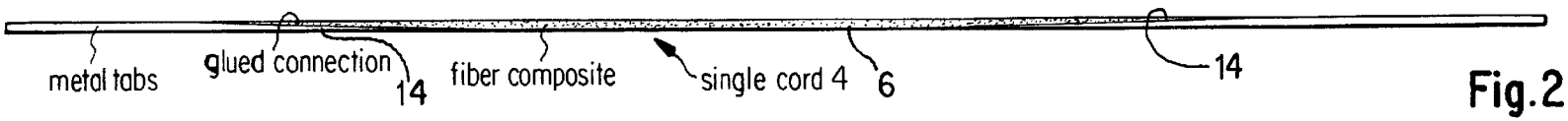
Figure 3:
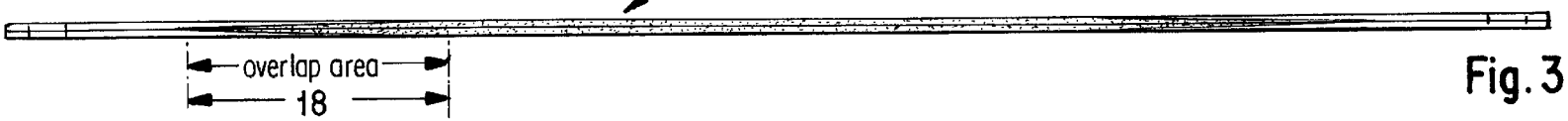
FIG. 3 is a side view of a double chord, glued together from the individual chords of FIG. 1 and FIG. 2.
Figure 4:
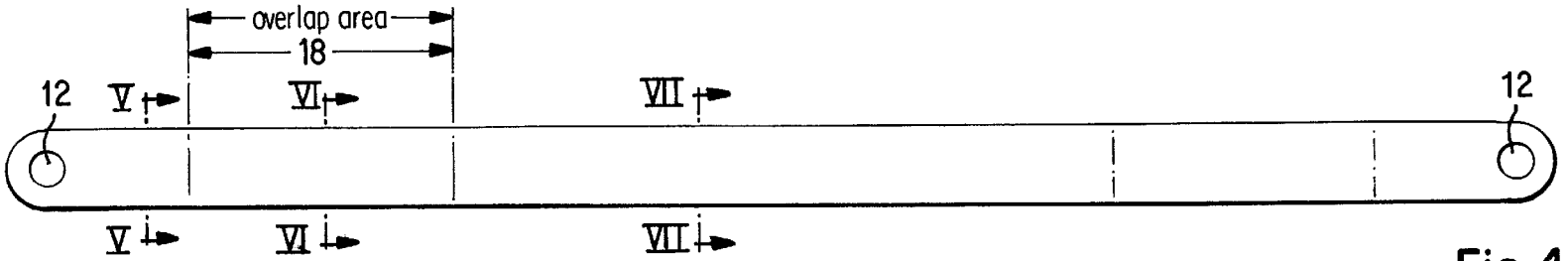
FIG. 4 is a top view of the double chord of FIG. 3.

FIGS. 1, 2, 3, 4, and 8 are drawn on the same page to make them easier to understand because FIG. 4 may be viewed as a top view of each of the chords shown above.

Figure 1:
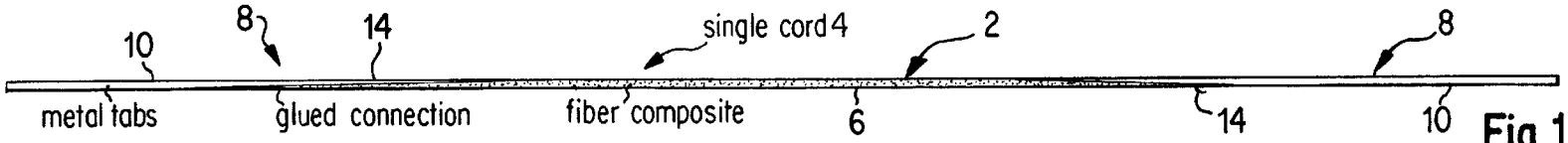
FIGS. 1 and 2 each show a side view of an individual chord with overlapping fiber-reinforced plastic composites according to a preferred embodiment of the present invention.

FIG. 1 shows a tension rod 2 as a single chord 4 having a middle part 6 made of a fiber composite material and having end parts 8 which are metal tabs 10, each of which has a hole or an eye 12 (FIG. 4).

Metal tab 10 and fiber composite material middle part 6 are glued together by means of a glued tapered overlap 14 (glued connection). FIGS. 1 and 2 each show an individual chord 4 with overlapping fiber-reinforced plastic composites facing one another. Gluing together the individual chords in FIGS. 1 and 2 produces the double chord 16 in FIG. 3. Basically, the two individual chords 4 in FIG. 1 and FIG. 2 are the same. The tapered overlap 14 that appears mirror-symmetrically in FIGS. 1 and 2 is produced by rotating chord 4 in FIG. 2 180° around its lengthwise axis relative to chord 4 in FIG. 1.

Figure 7:
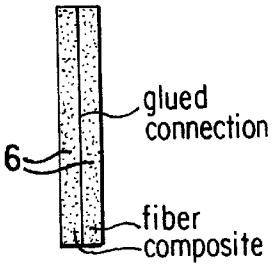
FIG. 7 is a sectional view taken along line C—C in FIG. 4.
Figure 6:
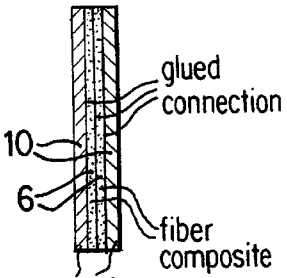
FIG. 6 is a sectional view taken along line B—B in FIG. 4.
Figure 5:
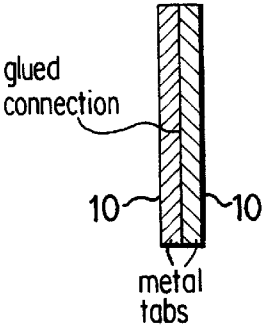
FIG. 5 is a sectional view taken along A—A in FIG. 4.

Sectional views A—A, B—B, and C—C in FIGS. 5, 6, and 7 show the various cross-sections of the double chord 16 in FIG. 3 and FIG. 4. At the end parts 8, inwardly-facing sides of the metal tabs 10 of the adjacent chords 4 of the double chord 16 are directly connected to each other via a glued connection 14, as shown in FIG. 5. Along the overlap areas 18 of the double chord 16, the metal tabs 10 have a tapering cross-section as viewed from the side in FIG. 3, with the fiber composite material middle parts 6 having a matingly corresponding tapering cross-section. At the overlap areas 18, the tapering area of each metal tab 10 is connected to the matingly corresponding tapering areas of its respective fiber composite material middle part 6 via a glued connection 14, and the opposite (i.e., inwardly-facing) sides of the middle part 6 are connected to each other via a glued connection 14, as shown in FIG. 6. At the central portion of the double chord 16 between the overlap areas 18, inwardly facing sides of the fiber composite material middle parts 6 of the adjacent chords 4 of the double chord 16 are directly connected to each other via a glued connection 14, as shown in FIG. 7.

As shown in FIGS. 3–4, the overlap area 18 is much longer than the thickness of the tension rod. The overlap area may be, for example, 50 times longer than the thickness of the tension rod. The overlaps extend bladewise toward the thin sides.

Figure 8:
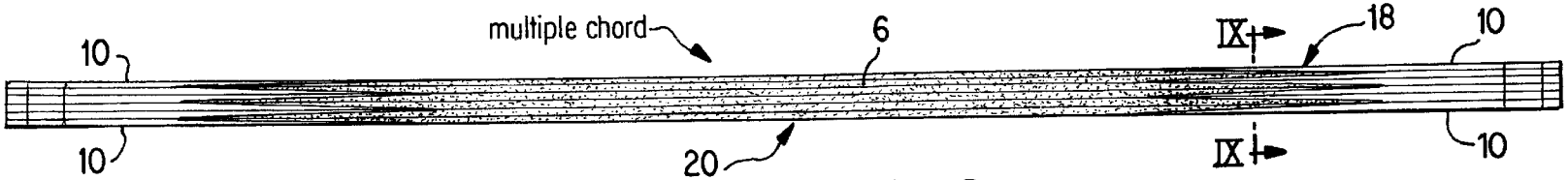
FIG. 8 is a side view of a multiple chord composed of three double chords of FIGS. 3 and 4 glued together.
Figure 9:
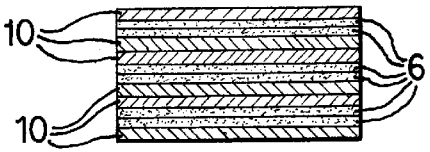
FIG. 9 is a sectional view taken along D—D in FIG. 8.

FIG. 8 shows a multiple chord 20 glued together from three double chords in FIG. 3. FIG. 9 shows a section in the vicinity of tapered overlap 18. In general, any number of double chords may be glued together to form a composite chord, depending upon the design specifications.

An example of an embodiment of a typical individual chord 4 in FIGS. 1 and 2 has a thickness of 10–20 mm, a width of 130–200 mm, and a length of 5–10 meters.

Following are examples of preferred materials, which are not intended to be limiting. The fiber composite consists primarily of lengthwise oriented carbon fibers with a heat-curing epoxy resin matrix. The metal fittings are made of steel, titanium, or aluminum. Heat-curing adhesive on a "carrier fabric min. 120° C.-system" is used as an adhesive connection.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A tension rod for use as a chord for bridges, comprising at least one chord, said at least one chord including:

a middle part made of a fiber composite material; and at least one end part made of a metallic material, wherein said at least one end part is connected to said middle part via a glued tapered overlap, the middle part and the end part having cross sections with a thick and a thin side at said overlap, a length of said overlap being greater than a thickness of the tension rod at the overlap, and said overlap of the fiber composite part and the metal part extending gradually decreasing in thickness on the thin sides, the glued connection between said tapered overlap of the middle part and said tapered overlap of the at least one end part forming a multi-layer connection between the middle part and the at least one end part with only one layer of at least one of the middle part and end part material;

wherein a cross-sectional size of said tension rod is constant throughout a length of the tension rod.

2. A tension rod according to claim 1, comprising at least two of said chords, said chords being glued together to form a multiple chord.

3. A tension rod according to claim 2, wherein at least two of the at least two chords are glued together mirror-symmetrically.

4. A tension rod according to claim 1, wherein the middle part and the at least one end part have a rectangular cross section at the overlap.

5. A tension rod according to claim 1, wherein the at least one end part includes two end parts, and wherein each longitudinal end of the middle part is connected to one of the end parts.

6. A tension rod according to claim 1, wherein the at least one end part is a metal tab having a hole to form an end fitting usable as coupling point of the tension rod.

7. A tension rod according to claim 1, wherein the chord has a thickness of 10–20 mm, a width of 130–200 mm and a length of 5–10 meters.

8. A tension rod according to claim 1, wherein the fiber composite material consists primarily of lengthwise oriented carbon fibers with a heat-curing epoxy resin matrix.

9. A tension rod according to claim 1, wherein the at least one end part is made of one of steel, titanium and aluminum.

10. A tension rod according to claim 1, wherein the glued connection is a heat-curing adhesive connection.

11. A tension rod for use as a chord for bridges, comprising at least one chord, said at least one chord including:

a middle part made of a fiber composite material; and at least one end part made of a metallic material, wherein said at least one end part is connected to said middle part via a glued tapered overlap, the middle part and the end part having cross sections with a thick and a thin side at said overlap, a length of said overlap being greater than a thickness of the tension rod at the overlap, and said overlap of the fiber composite part and the metal part extending gradually decreasing in thickness on the thin sides, the glued connection between said tapered overlap of the middle part and said tapered overlap of the at least one end part forming a multi-layer connection between the middle part and the at least one end part with only one layer of at least one of the middle part and end part material;

wherein the length of said overlap is at least fifty times the thickness of the tension rod at the overlap.

12. A tension rod according to claim 11, wherein the length of said overlap is fifty times the thickness of the tension rod at the overlap.

13. A tension rod, comprising at least one chord, said at least one chord including:

a middle part made of a fiber composite material, said middle part having a cross section which gradually decreases in thickness at least at one of its longitudinal ends to define a tapered connection area;

at least one end part made of a metallic material and having a cross section which gradually decreases in thickness at one longitudinal end to define a tapered connection area which matingly corresponds to the tapered connection area of the middle part; and a glued connection between said tapered connection area of the middle part and said tapered connection area of the at least one end part, forming a multi-layer connection between the middle part and the at least one end part with only one layer of at least one of the middle part and end part material;

wherein a length of said tapered connection areas is at least fifty times a thickness of the tension rod.

14. A tension rod according to claim 13, wherein a length of said tapered connection areas is fifty times the thickness of the tension rod at the overlap.

15. A tension rod, comprising at least one chord, said at least one chord including:

a middle part made of a fiber composite material, said middle part having a cross section which gradually decreases in thickness at least at one of its longitudinal ends to define a tapered connection area;

at least one end part made of a metallic material and having a cross section which gradually decreases in thickness at one longitudinal end to define a tapered connection area which matingly corresponds to the tapered connection area of the middle part; and a glued connection between said tapered connection area of the middle part and said tapered connection area of the at least one end part, forming a multi-layer connection between the middle part and the at least one end part with only one layer of at least one of the middle part and end part material;

wherein a cross-sectional size of said tension rod is constant throughout a length of the tension rod.

16. A tension rod according to claimed 15, comprising at least two of said chords, said chords being glued together to form a multiple chord.

17. A tension rod according to claim 16, wherein at least two of the at least two chords are glued together mirror-symmetrically.

18. A tension rod according to claim 15, wherein the middle part and the at least one end part have a rectangular cross section.

19. A tension rod according to claim 15, wherein the at least one end part includes two end parts, and wherein each longitudinal end of the middle part is connected to an end part.

20. A tension rod according to claim 15, wherein the at least one end part is a metal tab having a hole to form an end fitting usable as coupling point of the tension rod.

21. A tension rod according to claim 15, wherein the chord has a thickness of 10–20 mm, a width of 130–200 mm and a length of 5–10 meters.

22. A tension rod according to claim 15, wherein the fiber composite material consists primarily of lengthwise oriented carbon fibers with a heat-curing epoxy resin matrix.

23. A tension rod according to claim 15, wherein the at least one end part is made of one of steel, titanium and aluminum.

24. A tension rod according to claim 15, wherein the glued connection is a heat-curing adhesive connection on a carrier fabric.

25. A method of making a chord of a tension rod, comprising:

providing a middle part made of a fiber composite material, said middle part having a cross section which gradually decreases in thickness at least at one of its longitudinal ends to define a tapered connection area;

providing at least one end part made of a metallic material and having a cross section which gradually decreases in thickness at one longitudinal end to define a tapered connection area which matingly corresponds to the tapered connection area of the middle part;

gluing said tapered connection area of the middle part to said tapered connection area of the at least one end part, thereby forming a multi-layer connection between the middle part and the at least one end part with only one layer of at least one of the middle part and end part material; and gluing together at least two of said chords to form a multiple chord.

26. A method according to claim 25, further comprising providing the middle part and the at least one end part with a rectangular cross section.

27. A method according to claim 25, wherein said providing at least one end part includes providing a pair of end parts at respective opposite ends of the middle part, and providing the middle part with respective tapered connection areas at each longitudinal end.

28. A tension rod, comprising at least one chord including:

a middle part made of a fiber composite material, said middle part having a rectangular cross section which gradually decreases in thickness at each longitudinal end to define tapered connection areas;

a pair of end parts made of a metallic material, each of said end parts having a rectangular cross section which gradually decreases in thickness at one longitudinal end to define a tapered connection area which matingly corresponds to the respective tapered connection area of the middle part; and a glued connection between said tapered connection areas of the middle part and said tapered connection areas of the end parts, respectively;

wherein a cross-sectional size of said tension rod is constant throughout a length of the tension rod.

29. A tension rod, comprising at least one chord including:

a middle part made of a fiber composite material, said middle part having a rectangular cross section which gradually decreases in thickness at each longitudinal end to define tapered connection areas;

a pair of end parts made of a metallic material, each of said end parts having a rectangular cross section which gradually decreases in thickness at one longitudinal end to define a tapered connection area which matingly corresponds to the respective tapered connection area of the middle part; and a glued connection between said tapered connection areas of the middle part and said tapered connection areas of the end parts, respectively;

wherein a length of said tapered connection areas is at least fifty times a thickness of the tension rod.

30. A method of making a chord of a tension rod, comprising:

providing a middle part made of a fiber composite material, said middle part having a rectangular cross section which gradually decreases in thickness at each longitudinal end to define tapered connection areas;

providing a pair of end parts made of a metallic material, each of said end parts having a rectangular cross section which gradually decreases in thickness at one longitudinal end to define a tapered connection area which matingly corresponds to the respective tapered connection area of the middle part;

gluing said tapered connection areas of the middle part to said tapered connection areas of the end parts, respectively; and gluing together at least two of said chords to form a multiple chord.

* * * * *